United States Patent [19]

Haenni et al.

[11] 4,235,139

[45] Nov. 25, 1980

[54] AUTOMATIC SHEARING APPARATUS

[75] Inventors: Eduard A. Haenni, Zofingen; Christian Ragettli, Gockhausen, both of Switzerland

[73] Assignee: Haemmerle A.G., Zofingen, Switzerland

[21] Appl. No.: 925,330

[22] Filed: Jul. 17, 1978

[30] Foreign Application Priority Data

Jul. 20, 1977 [DE] Fed. Rep. of Germany ..... 2732689

[51] Int. Cl.[3] ..... B26D 7/16

[52] U.S. Cl. ..... 83/278; 83/36; 83/251; 83/418; 83/419

[58] Field of Search ..... 83/36, 250, 251, 278, 83/71, 418, 419, 519, 421

[56] References Cited

U.S. PATENT DOCUMENTS

| | | | |
|---|---|---|---|
| 3,598,007 | 8/1971 | Williams et al. | 83/36 |
| 3,820,431 | 6/1974 | Peddinghaus | 83/278 |
| 3,877,332 | 4/1975 | Roch | 83/36 X |
| 3,890,862 | 6/1975 | Lhenry | 83/36 X |
| 4,090,703 | 5/1978 | Straube | 83/418 X |

FOREIGN PATENT DOCUMENTS

| | | | |
|---|---|---|---|
| 647252 | 6/1937 | Fed. Rep. of Germany | 83/418 |

*Primary Examiner*—J. M. Meister

*Attorney, Agent, or Firm*—Abraham Saffitz

[57] ABSTRACT

Automatic power shearing apparatus and method for trimming sheet material into finished blanks comprising blade means, x and y axis feeding means and sheet feeding means including a first power driven means for moving the sheet in x and y directions and a second means responsive to a control acting to move the sheet in preselected directions by a constant counter balance against the first power driven means.

3 Claims, 5 Drawing Figures

AUTOMATIC SHEARING APPARATUS

BACKGROUND OF THE INVENTION

This invention relates generally to machine tools, and more paritcularly to a shearing machine wherein cuts are made simultaneously on intersecting lines to produce a finished blank from a sheet positioned and held by power driven means and a numerically controlled feeding device.

It is quite common for the shear operator to line up metal sheets in a working position either by hand or by means of feeding devices in the course of which the sheets are moved against adjustable end stops.

In addition to conventional well known and widely used shears, there are patents referring to apparatus for cutting sheet metal into blanks along a pre-determined line by means of a shear with two cutting edges which are located at right angles to one another. In this apparatus, the sheet is arranged on a carriage that can be moved in two directions and held on the edge opposite to the shear by two clamps. The sheet is then positioned relative to the two cutting edges intersecting at right angles in such a way that only the piece to be cut off is located in the enclosed space formed by the cutting edges, whereas the remainder of the metal sheet is outside this space. This system has a large floor-space requirement and precludes the possibility of stacking the various pieces of cut sheet metal individually. In addition, it is not possible to trim a sheet on all four sides to "square it up".

Although the aforementioned patents deal with various methods and forms of apparatus for cutting metal materials, none of them is intended for shearing blanks of assorted sizes from sheet metal material. There remains a need for equipment capable of economically and accurately shearing sheet metal material into finished blanks of desired sizes.

SUMMARY OF THE INVENTION

Described briefly, in a typical embodiment of the present invention a an apparatus is proposed for the positioning and cutting of metal sheets.

The method of the apparatus for power shearing sheet material to trim it into finished blanks of various desired final dimensions, comprises the steps of positioning the sheet in a suitable cutting position by turning and sliding said sheet, power driving of said sheet by feed effects acting alternatively in the x-axis and y-axis directions with respect to the sheet, power driving of said sheet simultaneously by a constant counter-force acting in selected directions in order to counter-balance the feed effects.

In this manner the sheet to be cut can be positioned without end stops. The resulting effect of the feed- and counter-forces enables the sheet to be accurately positioned. A numerical counter means can be used in the of the feeding force which enables the position of the sheet to be accurately determined without the use of end stops.

The shear assembly used for this system is particularly well suited for positioning metal sheets that are to be cut into individual blanks along pre-determined lines by a metal shearing machine and numerically controlled feeding device. The working surface of the shear assembly is partially limited by the two blades of the right-angle shear to receive and support the sheets to be cut. The surface comprises a turning means and a movable feeding device that is numerically controlled and capable of alternately exerting forces to the sheet along the x- and y-axes. The area of the working surface that is bounded by the two shear blades is fitted with an additional, fixedly located feeding system for developing a counter-force whose angular direction of action is adjustable. The effective feeding force exerted by the two movable feeding devices during the feeding phase is greater than the force exerted by the fixedly mounted feeding system. Once the desired position has been reached, feeding forces and counter-force are in equilibrium.

BRIEF DESCRIPTION OF THE DRAWINGS

In the accompanying drawings there is schematically shown one embodiment of the shear assembly in which.

DETAILED DESCRIPTION OF A PREFERRED EMBODIMENT

Figure 5:
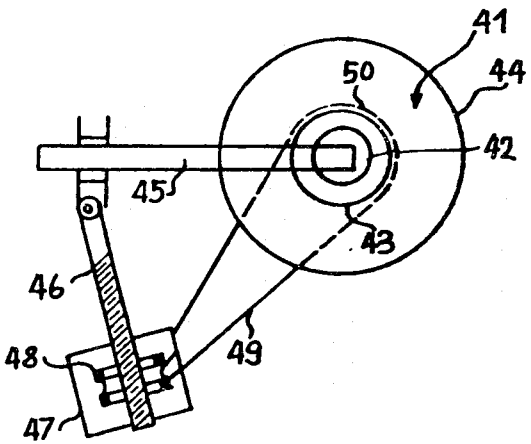
FIG. 5 is a detail of the chain drive.
Figure 1:
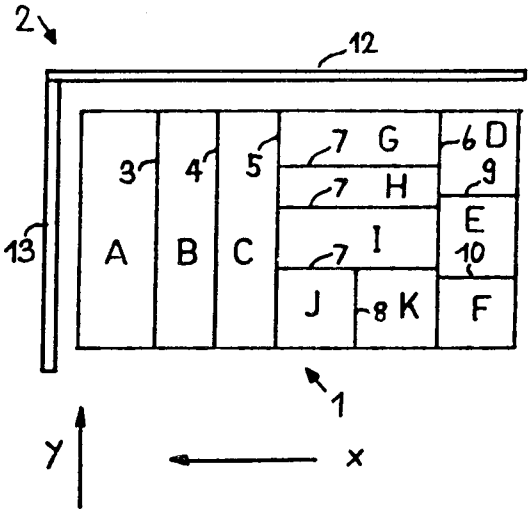
FIG. 1 is a schematic sketch of the general arrangement.

A metal sheet 1, illustred in FIG. 1 is to be cut into individual blanks A to K along pre-determined lines 3 to 10 by means of a corner notching shear 2. The corner notching shear is fitted with two blades that can be moved independently of one another blade 12 is for length-cuts and blade 13 is for cross-cuts. It is understood that the construction and operation of a corner notching shear as e.g. per DAS No. 1.777.184 is well known to a person skilled in the art. A feeding force is applied to metal sheet 1. The force can be exerted alternatively in two directions that are at right angles to one another. The one direction x runs parallel to blade 12 and the second direction y parallel to the cross-cut blade 13. At the same time, a counter-force is being applied to the metal sheet 1. The direction of action of this force can be selected. It counter-balances at least partially the feeding force as will described later in more detail. After the metal sheet 1 has been positioned as regards feed directions x and y, the feed in the x-direction takes place until the cutting line 3 is located exactly under the cross-cut blade 13. This blade is actuated and cuts off sheet metal blank A. Subsequently, cuts are made on the lines 4, 5 and 6 once again in the feed direction x. The blank located between cut-off lines 5 and 6, which is to be cut into smaller blanks, is drawn back against directional arrow x and moved in the y-direction to the length-cut blade 12, whereupon a cut along line 7 is made. In a similar manner blanks D, E and F are cut off along lines 9 and 10 and blanks J and K are produced by cutting on line 8 with blade 13. Moving of the metal sheet in the x and y directions is monitored and controlled by a numerical control device in the feed mechanism as shown in FIG. 5. In this way it is quite easy to stack sheet metal blanks of the same size on the same pile.

Figure 2:
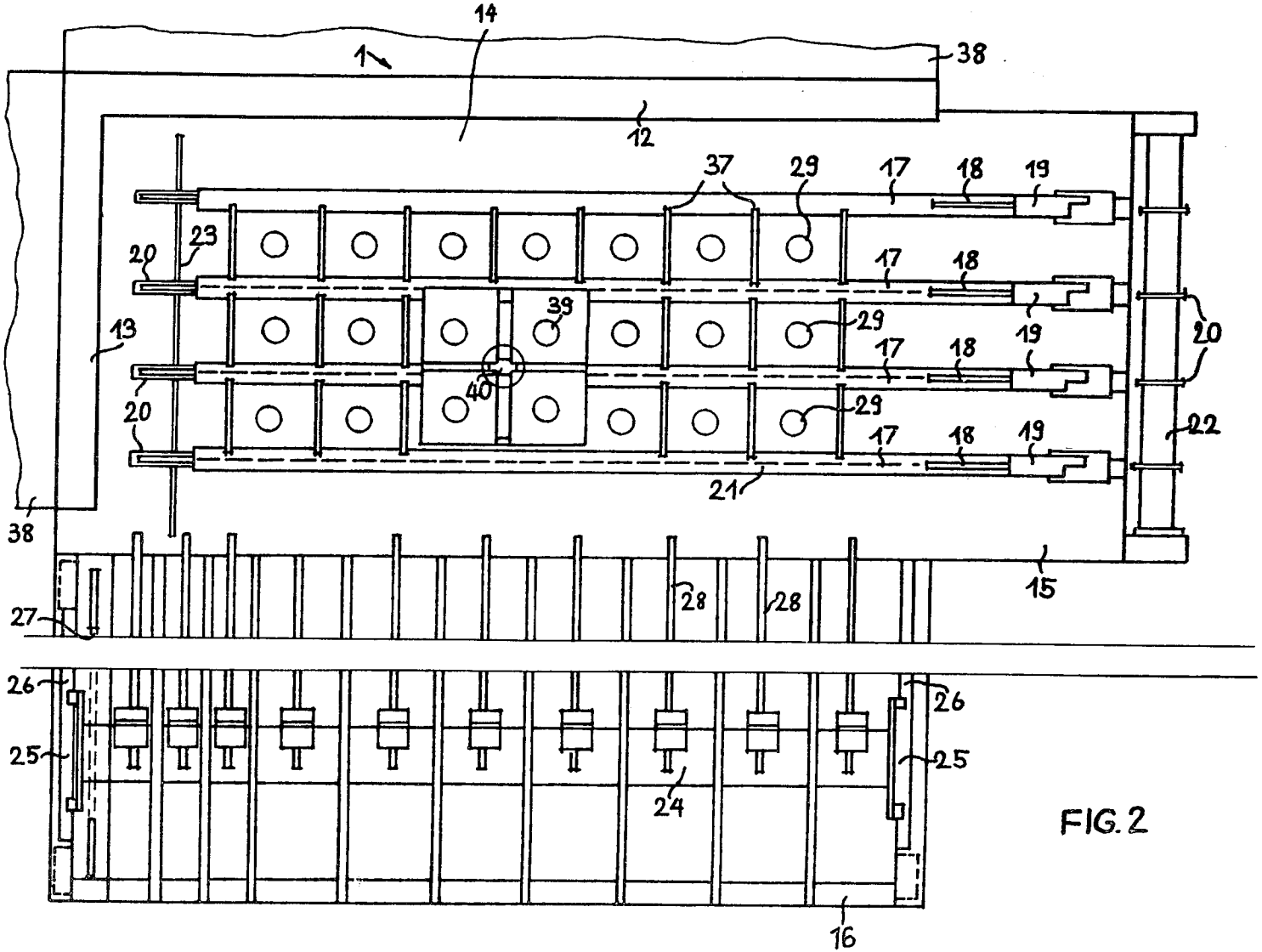
FIG. 2 is a schematic representation of the equipment in plan view.

The procedure that has been described above in principle is carried out with the help of the equipment shown in FIG. 2. This shows the same corner notching shear 1 with length-cut and cross-cut blades 12 and 13 respectively. Blades 12 and 13 limits the length and the width at a working surface 14 upon which the metal sheets are placed that must be cut. The working surface includes a working table 15 that is adjacent to the length-cut blade 12. Another table 16, which is located next to it, extends the working surface in the direction of the cross-cut blade 13.

A movable feeding device is provided on tables 15 and 16, which acts in the direction of the length-cut blade 12 and in the direction of the cross-cut blade 13. For this purpose grooves 17 are provided in table 15 that run parallel to one another and to blade 12. Fingers 18, that can be swivelled in the vertical plane, are recessed in the grooves 17. The fingers can be slid along the grooves. Each finger 18 is connected to a drive mechanism 19 that moves in groove 17 and is driven by an endless chain 21 that runs on sprocket wheels 20.

Figure 3:
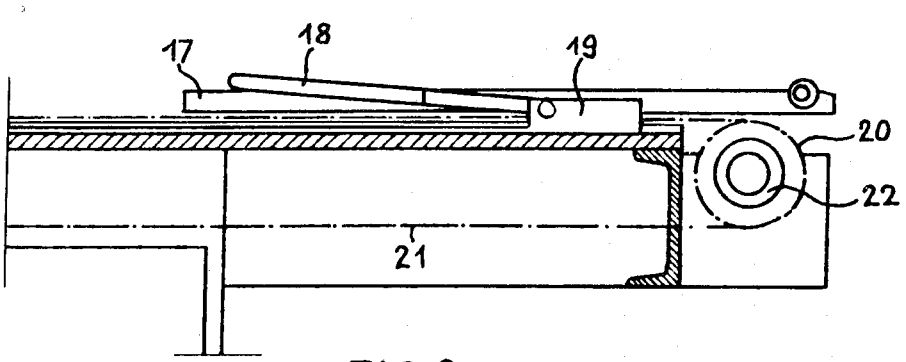
FIG. 3 is a detail of the movable feeding system which develops a counter force to the moveable feeding system whose angle is adjustable.

The fingers 18 can be snapped up in the vertical plane out of the grooves,as shown more clearly in FIG. 3. The sprocket wheels 20 are located on a drum 22 as shown in FIG. 3 or on a cross-shaft 23 which runs parallel to the cross-cut blade at both ends of the table 15 and as shown in FIG. 2.

A cross beam 24 running parallel to the length-cut blade 12 is located on table 16 as shown in FIG. 2. Drive mechanisms 25 which run in guides 26 are fitted to both ends of the cross beam. Synchronized chain drives 27 are provided at both ends of the beam for moving the drive mechanisms 25 with the cross beam 24. The moveable fingers 28 fitted to beam 24 are placed parallel to one another and to the cross-cut blade 13. The ends of the fingers are provided with pushing knobs, not shown. The fingers 18 can be moved parallel to the length-cut blade 12 and fingers 28 parallel to cross-cut blade 13. The drive, which is numerically controlled, is not the subject of this invenion. It is of known, conventional design and will not be described further. The fingers 18 and 28, including their guiding and control devices, form the movable feeding system. The pushing knobs on the fingers 28 can rotate around the feed axis. They are mounted in such a way that in one of the rotaty positions they are oriented in the plane of the metal sheets that are to be pushed and in the other position, after being turned 90°, they are underneath this plane. The fingers 18 can be snapped down into the grooves to leave the working surface free and to be cut of the way being traversed by the fingers 28.

Figure 4:
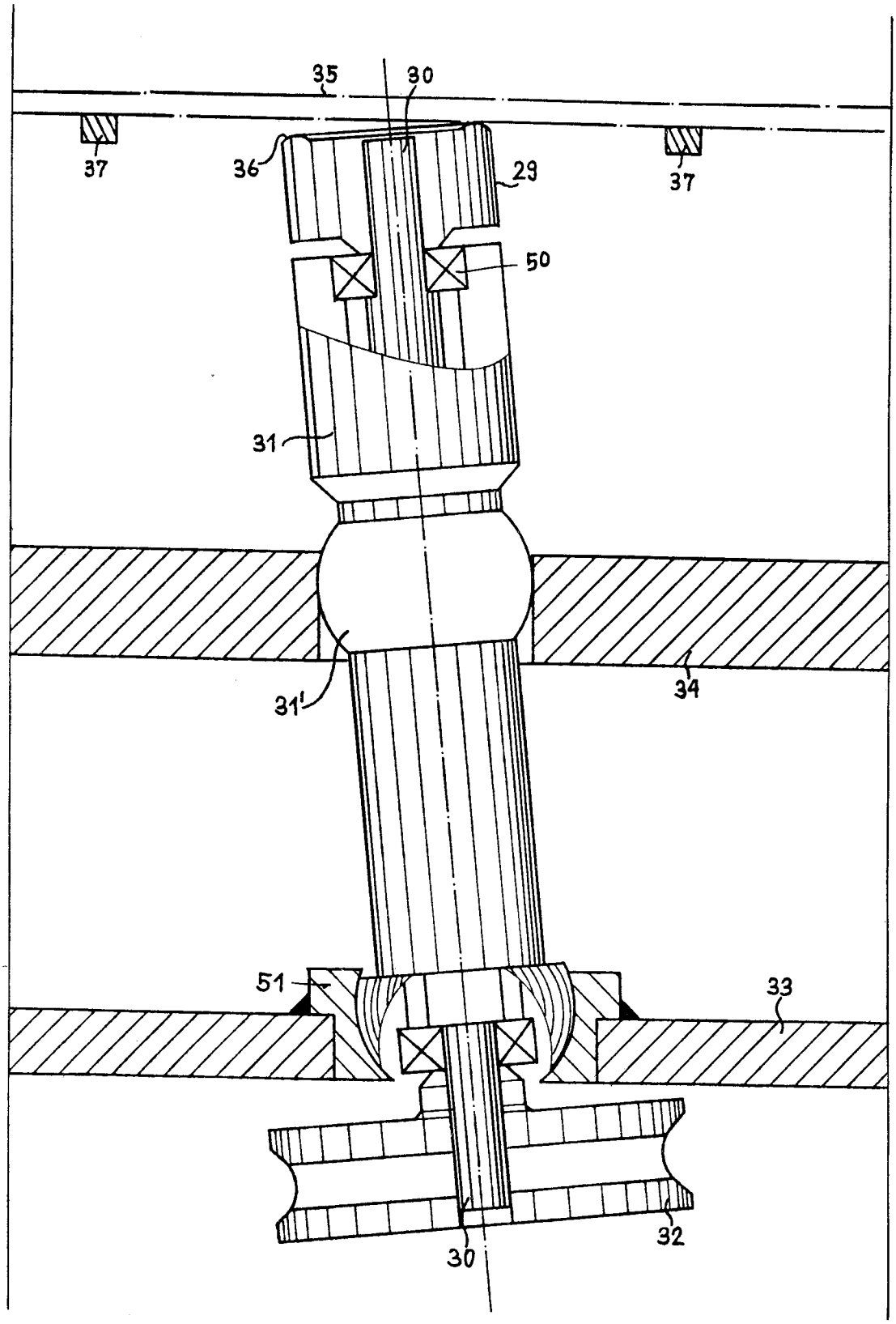
FIG. 4 is a detail of the fixed feeding system.

In addition to the movable feeding system described herein, a fixed feeding system of FIG. 4 is also provided which consists of a number of rollers 29 that are located equidistantly on table 15 and which serves to exert a counterforce which is adjustable in angular direction. The design of each roller can be seen more clearly in FIG. 4. It is placed on a drive shaft 30 which is freely rotatable into the sleeve 31 in which it is inserted. The sleeve can be swivelled to all sides by means of a spherical helmet-shaped bushing 31' in a supporting plate 34 in order that the inclination of the drive shaft 30 to the vertical axis can be adjusted as desired. The lower end of shaft 30—the opposite end from the roller 29—carries a driving sheave or pulley 32 for a belt drive and above this, a pneumatically or hydraulically movable control plate 33 is connected, by means of which the inclination of shaft 30 can be set in any desired direction. Further, a slip clutch is provided between the drive shaft 30 and the driving sheave 32. It may be designed as a simple friction disc.

The metal sheet 35 rests on a supporting grating 37 of table 15, in such a way, that the rollers 29 touch the sheet. The metal sheet 35 will be moved in a spectific, pre-determined direction in accordance with the inclination of the shaft 30 as it will only be contacted by a part of the upper edge 36 of roller 29.

Returning to FIG. 2, it must be mentioned that a supporting table 38 is located adjacent to and at the outer side of the length-cut blade 12 and/or the cross-cut blade.

The table is fitted with a return roll comprising a plurality of which rollers make it possible to convey cut-off blanks, either to a sheet stack, or, if it is necessary, to return these blanks to the working table 15.

A liftable table 39 is provided in the form of a retractable table as represented by the 4 squares located at about the middle of the table 15 as shown in FIG. 2. This table 39 is secured to rotatable post 3. When the table 39 is raised, the post 40 generates the required counter-force for turning the metal sheets.

When cutting metal sheets into blanks automatically, the moving of the sheets is accomplished by the numerically controlled fingers 18 and 28 and against the action of roller 29 as shown in the mechanism illustrated in FIG. 4 which will be explained herein after for which the angle is adjusted accordingly. The feeding force exerted by the fingers 18 or 28 is greater during the feeding cycle than the counter-acting force applied by the driven rollers 29. When the metal sheet is fed in a specific direction, for example, with fingers 28 against the length-cut blade 12, the row of fingers 18 forms the side guides for the metal sheet. In case the strip of metal cut off by blade 12 is to be processed further, it will be returned by the rollers of the supporting table 38 and then pulled back further by fingers 28 until the rollers 29 come into contact and begin to act.

Further it is possible with the help of the finger rows 18 and 28 to influence the stacking of the cut-off metal blanks in such a way that blanks of different sizes will be ejected onto different piles.

In order to trim a metal sheet lying on table 15 as shown in FIG. 4, the sheet is pushed by means of rollers 29 against fingers 18 the ends of which form a row in the y-axis and against fingers 28 whose ends form a row in the x-axis. Subsequently, both sets of fingers are actuated in order that the metal sheet will be positioned under blades 12 and 13 for trimming. By actuating the blades 12 and 13, the sheet will be trimmed on two intersection edges. Finger sets 18 and 28 are then drawn back to a point where the middle of the sheet lies over the center of the table. The table is then elevated against the post 40 and the metal sheet is rotated 180° in order that the two remaining edges can be trimmed in the manner described above.

Two chain drivers are provided in FIG. 5 to drive the feeding equipment, so that the metal sheets can be accurately positioned. They comprise angular step generators 41 which are provided with compensating devices, in order that inaccuracies caused by chain wear—which are additive—can be compensated. The step generators which are of known, conventional design, are fitted with rotors 42 that produce a given number of impulses per revolution. These are counted by the electronic numerical control unit and in this way the actual position of feeding fingers 18 and 28 is measured. The rotor of the step generator 41 is driven by the driving sprocket wheel 44 of the fingers 28, whereas the rotor of the other step generator 41 is driven by the sprocket wheel shaft 22 of the feeding fingers 18. To correct for the influence of play in the chain, the housings 43 of the step generators are mounted in such a way that they can be rotated around the rotor shafts in question. In this regard, the housing rotation for correcting play in the chain must be proportioned to the path travelled by the fingers. In order to accomplish this, the housings 43 are fitted with adjusting levers 45 which can be pivoted by means of spindles 46. The spindles are in actual contact with the sprocket wheel 44 or the chain shaft in that the sprocket wheel or chain shaft drives the worm wheel 47 and worm wheel 48 by means of auxiliary chain 49 and, the spindles.

The points of attack of spindles 46 on the adjusting levers 45 can be moved as a result of which the rotation of the step generator housing per revolutin of the sprocket wheel or sprocket wheel shaft can be adjusted according to the chain play. In this way it is possible to accomplish the feeding action of the fingers with a simple and inexpensive chain drive and, at the same time, to precisely maintain the high degree of accuracy required.

What we claim is:

1. In automatic power driven shearing apparatus adapted for simultaneously cutting two perpendicularly intersecting edges of a sheet along a predetermined line by means of a shear having two cutting edges located at right anges to each over and having a support for the sheet with means to move the sheet in the longitudinal or X direction and in the transverse or Y direction to bring the predetermined line into alignment with the cutting edge, that improvement comprising:

(1) a first moveable table provided with a plurality of equidistant grooves which are parallel to each other and parallel to the longitudinal blade of said shear (2) a second moveable table provided with a plurality of equidistant grooves which are parallel to each other and parallel to the transverse blade of said shear (3) a plurality of driven finger means to push the sheet in the X direction which are slideably moveable in the grooves of said first table, one finger means for each groove (4) a plurality of driven finger means to push the sheet in the Y direction which are slideably moveable in the grooves of said second table, one finger means for each groove (5) chain drive means to push the finger means in said first table (6) chain drive means to push the finger means in said second table (7) each said driven finger means in said first and second tables mounted to be rotated in one of two positions, the first position in the plane of the sheet being pushed and the second position, 90° from the first, underneath the plane of the sheet;and (8) a fixed feeding system exerting an adjustable angular force against the movements of said finger means on said first and second tables, comprising a shaft supported by bearings within a sleeve driven by a belt at a pulley at one end thereof having a roller at the other end thereof with a fulcrum formed by a spherical bushing mounted in a fixed plate and a spherical bearing mounted in a moveable control plate adjacent the pulley whereby said roller contacts said plate at an angle determined by the displacement of said sleeve within the bushing and spherical bearing.

2. Automatic shearing apparatus as claimed in claim 1 including a supporting grating for the fixed system wherein the sheet rests on the supporting grating on said first and second table.

3. Automatic shearing apparatus as claimed in claim 1 wherein a further liftable table as provided in the middle of said first tables and a said table is secured to a rotatable post adapting the placement of the sheet on said liftable table and rotating said table by said post to cut added edges of the sheet.

* * * * *